US005459948A

United States Patent [19]

Aveni

[11] Patent Number: 5,459,948

[45] Date of Patent: Oct. 24, 1995

[54] SHOE WITH MOVABLE FLAP HAVING GROUND ENGAGING ELEMENT

[75] Inventor: Michael A. Aveni, Lake Oswego, Oreg.

[73] Assignee: Nike, Inc., Beaverton, Oreg.

[21] Appl. No.: 213,533

[22] Filed: Mar. 16, 1994

[51] Int. Cl.[6] ..... A43B 3/24; A43B 5/12; A43C 15/00

[52] U.S. Cl. ..... 36/100; 36/61; 36/8.3

[58] Field of Search ..... 36/113, 100, 132, 36/136, 1, 8.3, 61, 62, 67 R, 67 D, 71.5, 59 R, 99, 126, 127, 128, 129, 130

[56] References Cited

U.S. PATENT DOCUMENTS

| | | | |
|---|---|---|---|
| 515,173 | 2/1994 | Scholding et al. | 36/72 |
| 2,372,828 | 4/1945 | Harvey | 36/61 |
| 2,445,353 | 7/1948 | Harvey | 36/61 |
| 2,723,467 | 11/1955 | Cassidy | 36/113 X |
| 2,776,499 | 1/1957 | Giuntini | 36/61 X |
| 2,934,838 | 5/1960 | Ferreira | 36/100 |
| 3,713,233 | 1/1973 | Hunnicutt | 36/61 |
| 4,114,295 | 9/1978 | Schaefer | 36/100 |
| 4,146,981 | 4/1979 | Renaldo | 36/100 |
| 4,364,187 | 12/1982 | Melendez | 36/100 X |
| 4,706,392 | 11/1987 | Yang | 36/101 |
| 4,745,693 | 5/1988 | Brown | 36/101 |
| 4,974,344 | 12/1990 | Ching | 36/101 |
| 5,210,963 | 5/1993 | Harwood | 36/77 |

*Primary Examiner*—Jimmy G. Foster
*Assistant Examiner*—BethAnne C. Cicconi
*Attorney, Agent, or Firm*—Banner & Allegretti, Ltd.

[57] ABSTRACT

A convertible shoe for multipurposes includes an upper and a sole attached to the upper. A flap is attached to the shoe and the flap has a ground engaging element disposed thereon. The flap has a first position wherein the flap is positioned in an overlying relationship to the upper and a second position wherein it is positioned in an overlying relationship to the sole such that the ground engaging element can contact the surface upon which the sole is being used.

25 Claims, 7 Drawing Sheets

SHOE WITH MOVABLE FLAP HAVING GROUND ENGAGING ELEMENT

BACKGROUND OF THE INVENTION

1. Field of the Invention

The present invention is directed to a shoe which is convertible between two configurations for two different uses. More particularly, the shoe is constructed such that an element, for example a tap or cleat or slide element, can be positioned along the bottom of the sole for one use and can be positioned along the upper of the shoe for a different use.

2. Description of the Prior Art

Numerous techniques are known for providing a single upper with multiple soles that are interchangeable. Various techniques, for example zippers and air bladders, can be used to attach the interchangeable soles to the upper as are demonstrated in U.S. Pat. Nos. 4,706,392; 4,745,693; 4,974,344. The use of zippers or air bladders to attach an interchangeable sole to an upper requires the alignment of the attaching structures of the upper and sole and the actuation of the zipper or air bladder to complete the attachment. Thus, as is apparent, such techniques can require a relatively long period of time to be effectuated and further can require the removal of the shoe from the foot. Further, these techniques can require the use of both hands of the shoe wearer to complete the change. These techniques are further disadvantageous because the interchangeable soles are completely separate and individual from the shoe upper such that in order for a shoe wearer to have the ability to change soles, such wearer must carry an additional pair of soles on himself or herself.

Other techniques are known for converting the appearance of a shoe upper. U.S. Pat. No. 2,934,838 discloses a shoe in which the appearance of the upper can be changed between a slip-on type and a tie Blucher-type. The technique disclosed does not allow the shoe wearer to change the functional use of the shoe by changing the configuration of the sole.

Other techniques are known in the art for positioning rigid protectors over the upper and sole of the shoe in the toe area and the heel area. U.S. Pat. No. 515,173 discloses a pair of shoe protectors positionable around the shoe in its toe and heel areas. The protectors can be made of metal and are generally cup-shaped such that they encircle both the upper and sole of the shoe in both its heel and toe areas. The protectors have ridges disposed on their bottom surfaces for increasing the traction of the shoe. Each of the protectors is held in position by a strap and buckle system. The protectors are disadvantageous in that they are apparently individually separate elements from the shoe and thus require the shoe wearer to carry the protectors with himself or herself in order to have the ability to change shoe uses. Furthermore, the positioning of the protectors around the toe and heel areas of the shoe and the strapping thereto will likely require a substantial amount of time, and further, likely require the use of both hands of the shoe wearer. Thus, the protectors discussed above do not allow easy switching between activities or uses and further require individual elements separate from the shoe to be attached to the shoe in a relatively burdensome way.

SUMMARY OF THE INVENTION

The present invention is directed to a convertible shoe for multipurposes having an upper and a sole attached to the upper. A flap is attached to the shoe and has a ground engaging element disposed thereon. The flap has a first position wherein the flap is positioned in an overlying relationship to the upper and a second position wherein the flap is positioned in an overlying relationship to the sole such that the ground engaging element can contact the surface upon which the sole is being used.

In another embodiment, the shoe has two flaps with a ground engaging element disposed on each flap. The first flap is positioned in the forefoot area of the shoe such that a first flap overlies the vamp of the upper when in a first position and a first ground engaging element is positioned on the bottom of the sole under the forefoot area when the first flap is in a second position. A second flap is positioned in the heel area of the shoe such that the second flap overlies the heel area of the upper when in a first position and a second ground engaging element is positioned on the bottom of the sole under the heel area when the second flap is in the second position.

The present invention provides the advantage of allowing the shoe wearer to change activities or uses of the shoe without physically removing his or her feet from the shoes. The switching between activities or uses can be accomplished easily and quickly by using a single hand. Further, rigid elements (for instance taps or cleats) or slide elements are readily available for disposition along the bottom of the sole of the shoe because of their attachment to the shoe itself. Therefore, the rigid or slide elements cannot be lost or misplaced. Thus, the present invention allows for one shoe to be used for two activities, such as aerobics wherein a rubber outsole is needed and tap-dancing wherein taps need to be disposed on the sole.

DETAILED DESCRIPTION OF THE PREFERRED EMBODIMENTS

Figure 1:
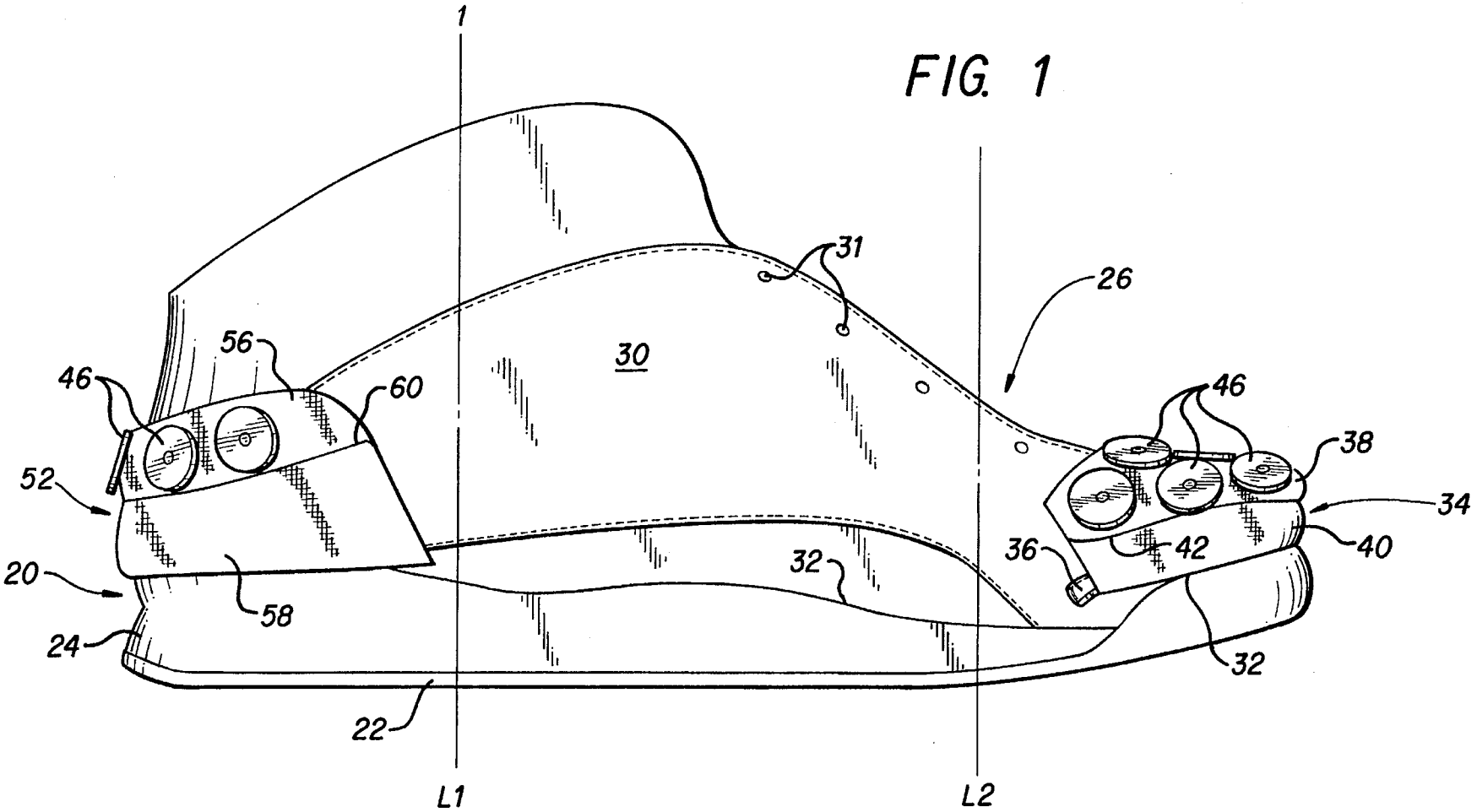
FIG. 1 is a side elevational view of the medial side of a shoe in accordance with the present invention wherein the forefoot flap with tap elements disposed thereon and the heel flap with tap elements disposed thereon are shown in their upper positions.

With reference to FIGS. 1–6, 9, and 10 a convertible shoe according to the present invention is shown. This embodiment is directed to a shoe that can be used for normal aerobics and for tap dancing or tap aerobics. The shoe includes a conventional sole 20 having a conventional outsole 22 and a conventional midsole 24. Upper 26 is secured to the upper surface of sole 20 and includes vamp 28 and medial and lateral quarters 30. Eyelets 31 are disposed on the top edges of quarters 30. A lace is positioned through eyelets 31 such that the upper can be tightened about the foot. Upper 26 has foot opening 33 for inserting the wearer's foot into the shoe. Upper 26 is made of a conventional material, for example synthetic or natural leather and is secured to sole 20 by conventional means, for example adhesive or stitching. Lasting margin 32 is the line formed where upper 26 meets sole 20.

The shoe can be divided into three general areas or sections which relate roughly to the three areas of the foot of the wearer. A heel area is located generally rearward of line L1; an arch area is located generally between lines L1 and L2; and a forefoot area is located generally forward of line L2. Lines L1 and L2 are intended to be diagrammatic and not to indicate precise lines of demarcation between the heel, arch and forefoot areas of the shoe. Lines L1 and L2 are indicated in the figures for the convenience of describing the present invention only. As is apparent, it is not necessary that the shoe be divided into three sections, and other divisions are possible.

Figure 2:
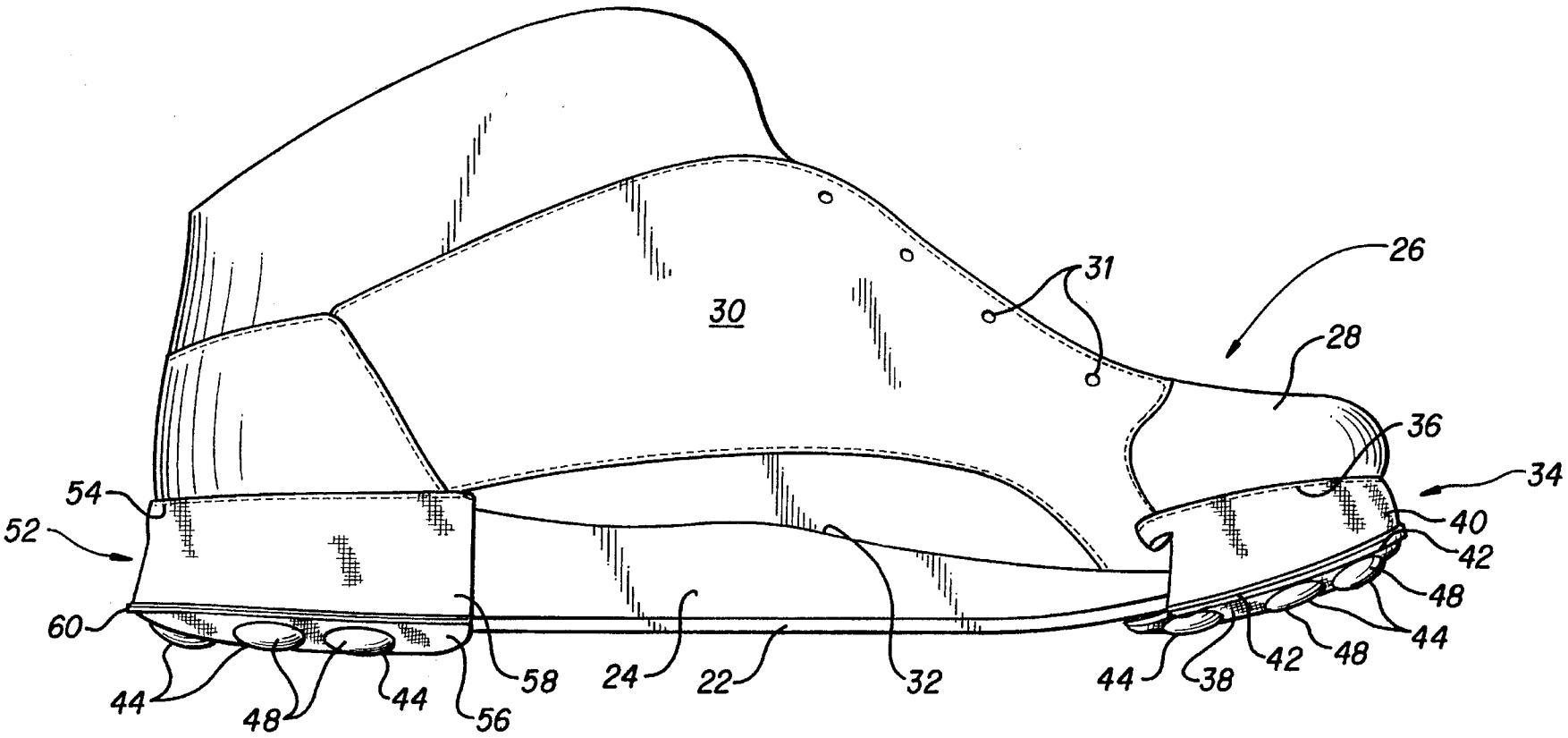
FIG. 2 is a side elevational of the shoe shown in FIG. 1 with the forefoot flap and the heel flap in their down positions.
Figure 7:
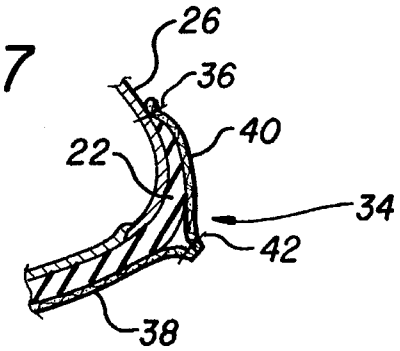
FIG. 7 is a sectional view taken along line 7—7 of FIG. 5.
Figure 5:
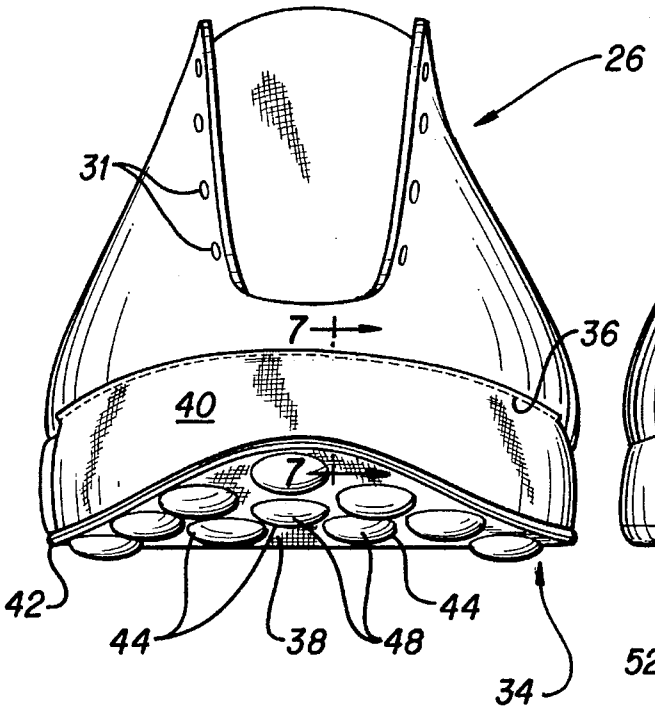
FIG. 5 is a front elevational view of the shoe shown in FIG. 1 with the forefoot flap in its down position.

With reference to FIGS. 1 and 2, a first flap 34 is shown attached to the forefoot area of upper 26. Forefoot flap 34 is made of a flexible elastic material, for example neoprene or rubber. As best shown in FIGS. 2, 5, and 7, forefoot flap 34 is attached to the outer surface of upper 26 along stitch line 36. However, forefoot flap 34 can also be attached to sole 20 or in between upper 26 and sole 20. Stitch line 36 extends from the medial side of the forefoot area of the upper around the front portion of the upper and to the lateral side of the forefoot area of the upper. Stitch line 36 follows a path that is adjacent to lasting margin 32. First flap 34 has a first section or portion 38 and a second section or portion 40. As shown in FIGS. 2, 5, and 7, first section 38 and second section 40 are attached along stitch line 42.

Ground engaging elements, such as rigid tap elements 44, are attached to first section 38 of forefoot flap 34. Tap elements 44 can be made of any substantially rigid material, for example metal, preferably cast aluminum. Tap elements 44 are riveted through first section 38 and are held in position on first section 38 by backing washers 46. Backing washers 46 can be made of any suitable rigid material, for example plastic, preferably nylon. Each of tap elements 44 has a ground engaging surface 48. When ground engaging surface 48 contacts the surface on which the shoe is used, it creates the tapping sound needed for tap dancing or tap aerobics.

Forefoot flap 34 is positionable between two positions: an upper or first position wherein flap 34 is in an overlying relationship to vamp 28 of upper 26 and a downward or second position wherein flap 34 is in an overlying relationship to sole 20 such that tap elements 44 are positioned on the bottom of sole 20 and can contact the surface upon which the sole is being used.

Figure 3:
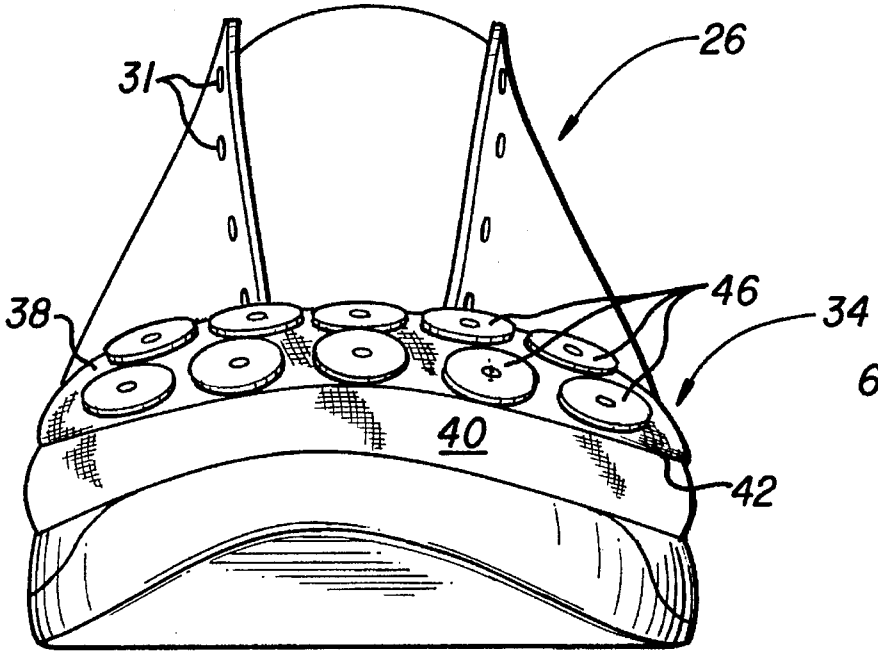
FIG. 3 is a front elevational view of the shoe shown in FIG. 1 with the forefoot flap in its upper position.
Figure 9:
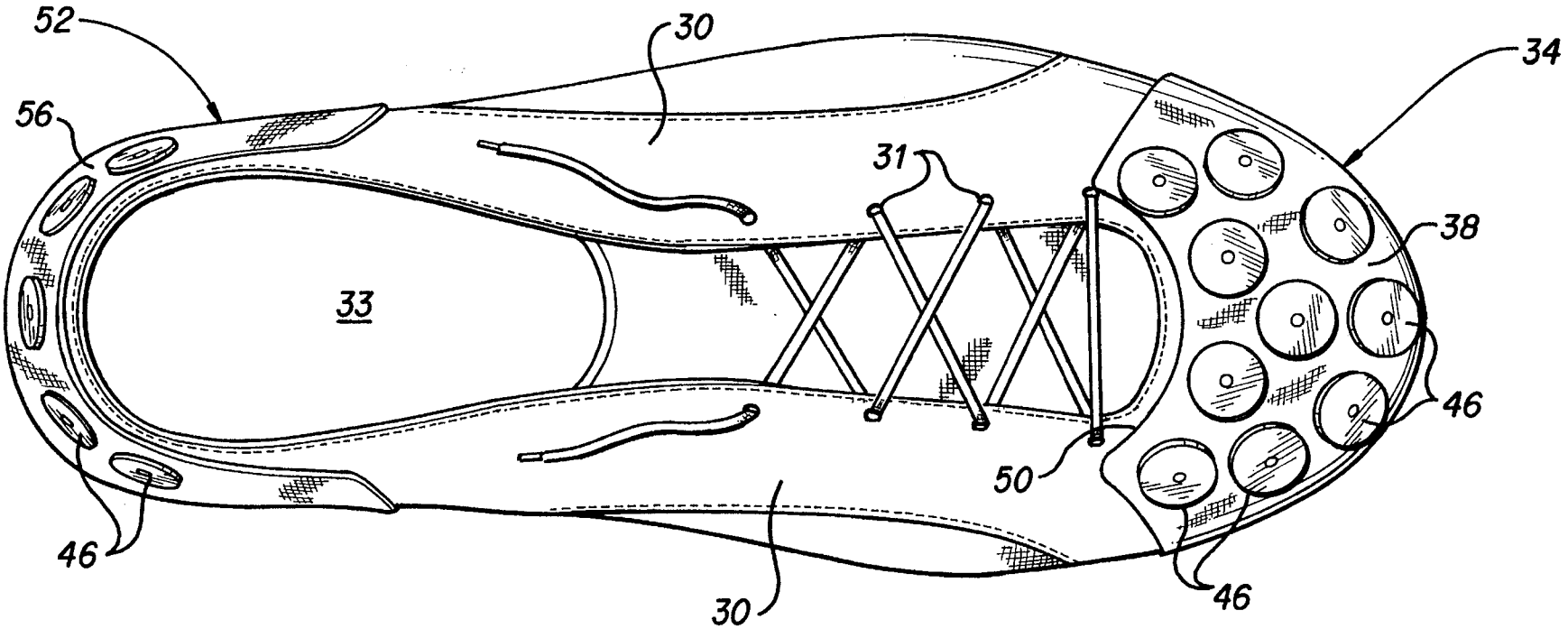
FIG. 9 is a top plan view of the shoe shown in FIG. 1 with the forefoot flap and the heel flap in their upper positions.

With reference to FIGS. 1, 3 and 9, forefoot flap 34 is shown in its first or upper position. In this position, forefoot flap 34 conforms to the shape of upper 26 and ground engaging surfaces 48 of tap elements 44 face against the outside surface of upper 26. The spacing in between tap elements 44 allows forefoot flap 34 to conform and curve to the shape of upper 26 in the forefoot area of the shoe. Forefoot flap 34 is held in its upper position along upper 26 by the elasticity of the material of which forefoot flap 34 is made. With reference to FIG. 9, forefoot flap 34 has arcuate edge 50 which provides forefoot flap 34 with a shape that does not interfere with the lacing of the shoe through eyelets 31.

Figure 10:
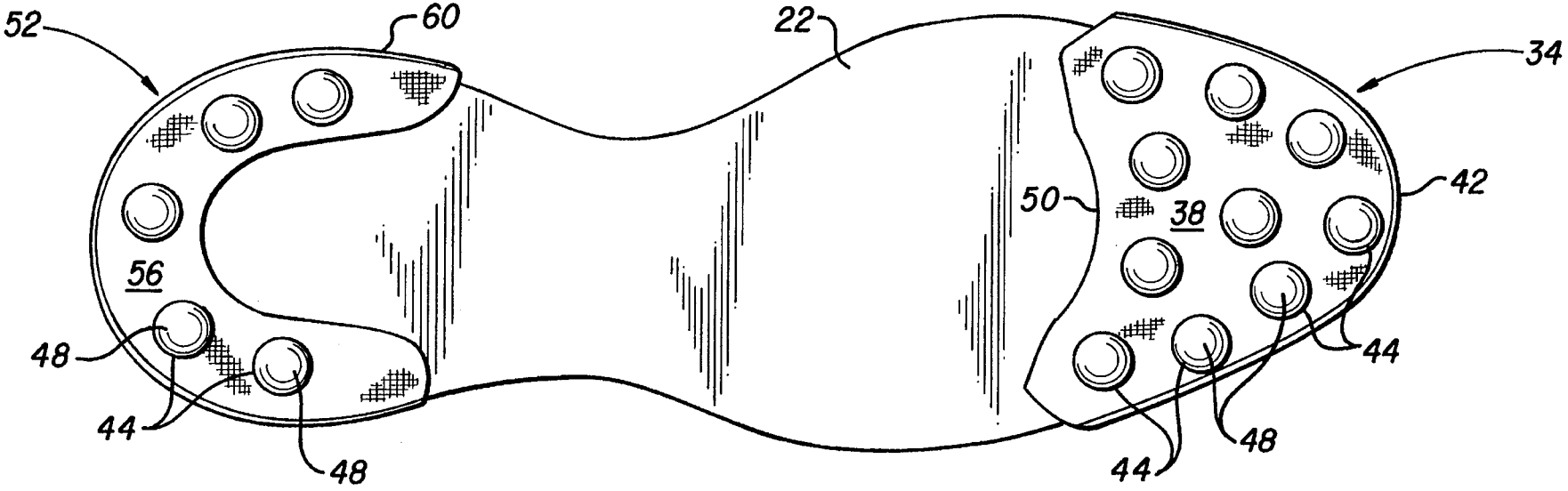
FIG. 10 is a bottom plan view of the shoe shown in FIG. 1 with the forefoot flap and the heel flap in their down positions.

With reference to FIGS. 2, 5, and 10, forefoot flap 34 is shown in its second or downward position. In the downward position of forefoot flap 34, tap elements 44 are positioned along the bottom of sole 20 such that ground engaging surfaces 48 of tap elements 44 can contact the ground upon which the shoe is being used and create the tapping sound necessary for tap dancing or tap aerobics. With reference to FIG. 10, first section 38 of forefoot flap 34 is positioned along the bottom of sole 20 when forefoot flap 34 is in its second or downward position. First section 38 of forefoot flap 34 is substantially the same shape as and substantially covers the forefoot area of sole 20 when forefoot flap 34 is in its second or downward position. Thus, in this position, tap elements 44 are able to contact the ground upon which the shoe is being used to create the tapping sound necessary for tap dancing. Forefoot flap 34 is held in its downward position because of the elasticity of the material of which forefoot flap 34 is made.

Section 40 of forefoot flap 34 is not under tension when it is stitched to upper 26 along stitch line 36. In other words, the elastic material of which section 40 is made is not stretched as it is stitched along stitch line 36. Further, neither first section 38 nor second section 40 of forefront flap 34 are stretched when they are stitched together along stitch line 42. However, in order to create additional elasticity in forefoot flap 34 to ensure that flap 34 stays in place in its first or upward position along the forefoot area of the upper and its second or downward position along the forefoot area of sole 20, tension can be imparted upon second section 40 of forefoot flap 34 during stitching. In other words, section 40 can be stretched as it is stitched along stitch line 36. Additionally, for the same reason of ensuring that forefoot flap 34 stays in its upward/first and downward/second positions, tension can be imparted to first section 38 and second section 40 of forefoot flap 34 when they are stitched together along stitch line 42.

Figure 8:
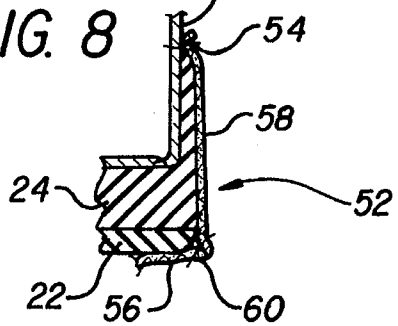
FIG. 8 is a sectional view taken along line 8—8 of FIG. 6.
Figure 6:
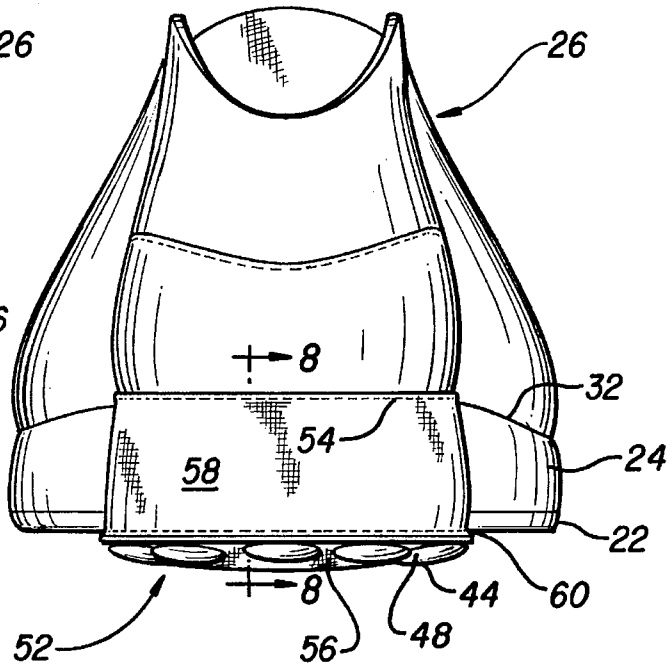
FIG. 6 is a rear elevational view of the shoe shown in FIG. 1 with the heel flap in its down position.

With reference to FIGS. 1 and 2, second flap 52 is positioned in the heel area of the shoe. Heel flap 52 is attached to upper 26 along stitch line 54 as best shown in FIGS. 2, 6 and 8. However, heel flap 52 can also be attached to sole 20 or in between upper 26 and sole 20. Stitch line 54 extends from the medial side of the heel area of upper 26 around the back of the shoe to the lateral side of the heel area of upper 26. Stitch line 54 follows a path that is generally adjacent to lasting margin 32. Heel flap 52 is made of a flexible elastic material, for example neoprene or rubber. Heel flap 52 has a first section or portion 56 and a second section or portion 58. As shown in FIGS. 2, 6 and 8, first section 56 and second section 58 are attached along stitch line 60.

Tap elements 44 are made of a substantially rigid material, for example metal, and are positioned on first section 56 of heel flap 52. Tap elements 44 disposed on first section 56 of heel flap 52 are identical to the tap elements disposed on first section 38 of forefoot flap 34. Tap elements 44 are riveted through first section 56 and held in place by backing washers 46 which are identical to the backing washers used on first section 38. Each tap element 44 has ground engaging surface 48.

Heel flap 52 is positionable between two positions: a first or upper position wherein heel flap 52 is in an overlying relationship to upper 26 in the heel area of the upper, and a second or downward position wherein heel flap 52 is in an overlying relationship to sole 20 in the heel area of the shoe such that tap elements 44 are positioned on the bottom of the sole and can contact the surface upon which the sole is being used.

Figure 4:
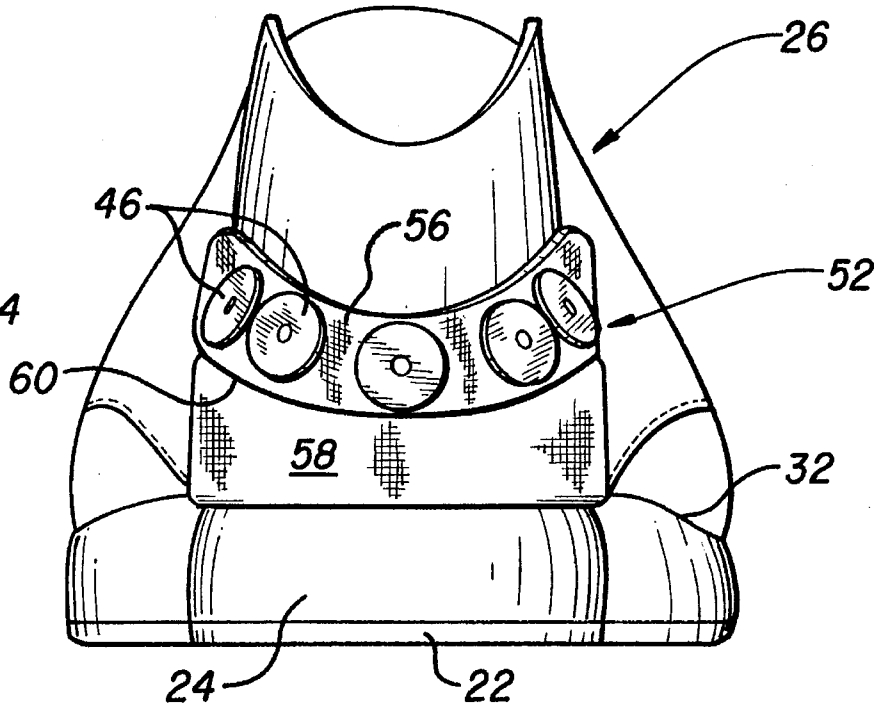
FIG. 4 is a rear elevational view of the shoe shown in FIG. 1 with the heel flap in its upper position.

Heel flap 52 in its first or upper position is shown in FIGS. 1, 4 and 9. In the first or upward position of heel flap 52, ground engaging surfaces 48 of tap elements 44 face against the outside surface of the portion of upper 26 located in the heel area. Tap elements 44 are spaced on first section 56 of heel flap 52 such that heel flap 52 can conform to the portion of upper 26 located in the heel area of the shoe. Heel flap 52 is held in its upward or first position by the elasticity of the material of which heel flap 52 is made.

Heel flap 52 in its second or downward position is shown in FIGS. 2, 6 and 10. In the downward or second position of heel flap 52, first section 56 of heel flap 52 with tap elements 44 disposed thereon is positioned along the bottom of sole 20 in the heel area of the shoe. In this downward or second position, ground engaging surfaces 48 of tap elements 44 face and are allowed to contact the surface upon which the shoe is to be used. Thus, tap elements 44 can create the tapping sound needed for tap dancing or tap aerobics when the shoe wearer strikes the heel area of the foot. As shown in FIG. 10, first section 56 of heel flap 52 has a generally U-shaped configuration. This U-shaped configuration allows first section 56 to surround the heel area of upper 26 when heel flap 52 is in its first or upper position as shown in FIGS. 1 and 4. The U-shaped configuration also positions tap elements 44 along the perimeter of the sole in the heel area of the shoe when heel flap 52 is in its second or downward position. Heel flap 52 is held in its second or downward position by the elasticity of the material of which the flap is made.

As with second section 40 of forefoot flap 34, second section 58 of heel flap 52 is untensioned when it is attached to upper 26 along stitch line 54. However, as with section 40 of forefoot flap 34, second section 58 of heel flap 52 can be tensioned or stretched when it is stitched along stitch line 54 to upper 26. Further, first section 56 and second section 58 of heel flap 52 are not tensioned or stretched when they are attached along stitch line 60. However, as with sections 38 and 40 of forefoot flap 34, both first section 56 and second section 58 can be tensioned or stretched when they are stitched along stitch line 60.

The structure of forefoot flap 34 and heel flap 52 described above allows the shoe to be easily convertible between two different uses. For example, the shoe described above can be used for normal aerobics, and further can be used for tap dancing or for a type of aerobics known as tap aerobics.

The shoe in its configuration for normal aerobics is shown in FIGS. 1, 3, 4 and 9. In this configuration, forefoot flap 34 and heel flap 52 are in their first or upper positions such that they conform to upper 26 in the forefoot area and heel area of the shoe, respectively. As discussed above, the elasticity of flaps 34 and 52 holds them in their upper positions and the spacing in between tap elements 44 allows the flaps to conform to the shape of upper 26. In this configuration, outsole 22 is completely exposed to the surface upon which the shoe is to be used.

The shoe configured for tap dancing or tap aerobics is shown in FIGS. 2, 5, 6 and 10. In this configuration, forefoot flap 34 and heel flap 52 are in their second or downward positions such that tap elements 44 are positioned on the bottom of sole 20 overlying outsole 22. In this position, ground engaging surfaces 48 of tap elements 44 are allowed to contact the surface upon which the shoe is used. Thus, a shoe wearer with the shoe in this configuration can create a tapping sound by striking the forefoot area or heel area of the sole upon the surface which the shoe is used.

In order to switch between the two configurations, a shoe wearer simply flips or positions flaps 34 and 52 from their upper positions to their downward positions and vice versa. As stated above, both flaps 34 and 52 are made of elastic material and thus are held in their positions by the elasticity of the material.

The attachment of the flaps with tap elements 44 disposed thereon to the shoe allows the shoe wearer to change activities or uses of the shoe without physically removing his or her foot from the shoe and further allows switching the configuration of the shoe by using a single hand. For instance, a single hand can be used to flip the forefoot flap to its upper position and then the same hand can be used to flip the heel flap to its upper position. The shoe described above provides the further advantage of the taps being attached to the shoe such that they can never become misplaced or lost. Additionally, as is apparent, all that is needed to switch between the two configurations is a simple flipping of flaps 34 and 52 which can be readily accomplished in a relatively short amount of time.

Figure 11:
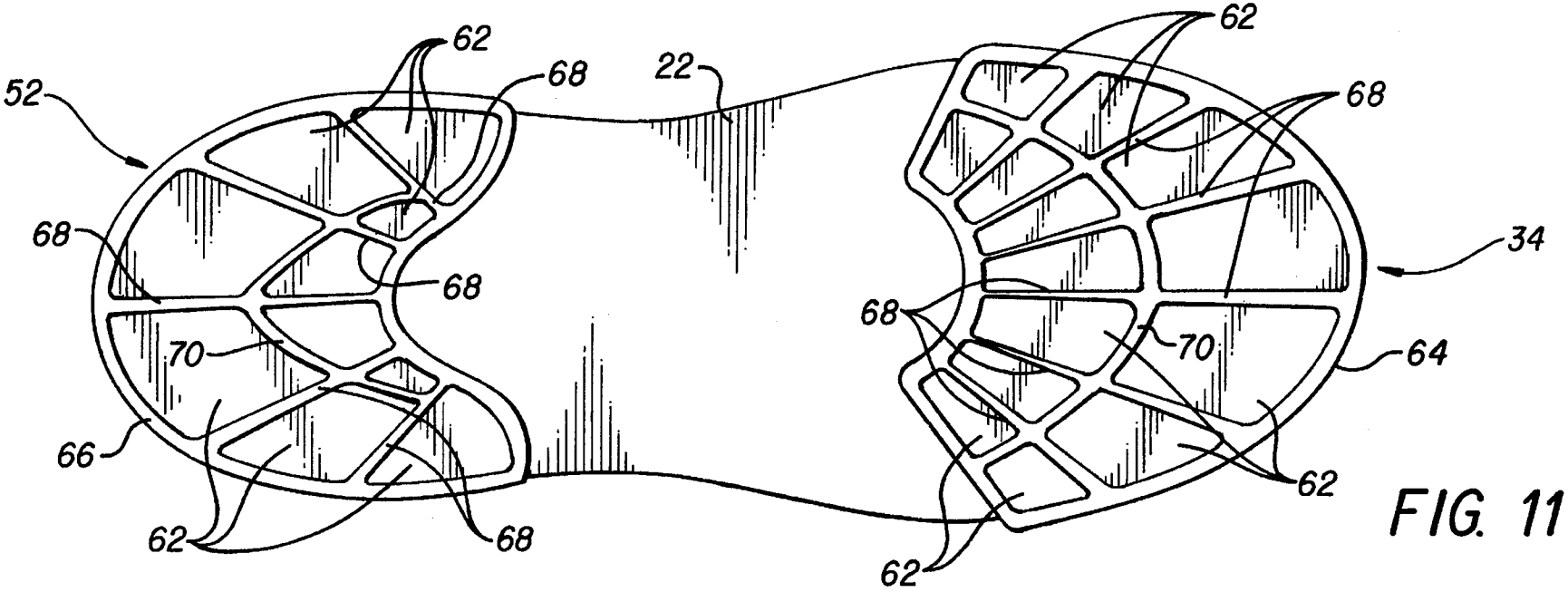
FIG. 11 is a bottom plan view similar to FIG. 10, but showing a shape and configuration for slide elements disposed on the forefoot flap and heel flap.

With reference to FIG. 11, low friction slide elements 62 for use in slide aerobics are shown. Slide aerobics involves a person sliding laterally back and forth along a plastic sheet in a form similar to that used by an ice speed skater. Slide elements 72 have a lower coefficient of friction than outsole 22 such that when slide elements 72 are positioned along the sole of the shoe the slide elements are in contact with a plastic sheet used in slide aerobics. Slide elements 62 shown in FIG. 11 are generally rectangular or triangular in shape. Slide elements 62 are attached to alternative first section 64 of forefoot flap 34 and to alternative first section 66 of heel flap 52. Slide elements 62 are separated by radial spaces 68 and curved spaces 70. Thus, slide elements 62 in conjunction with spaces 68 and 70 allow forefoot and heel flaps 34 and 52 to conform to upper 26 in the forefoot area and heel area of the shoe, respectively. Slide elements 62 are made out of a relatively low friction material, for example woven nylon fabric, such that they easily slide along the plastic slide surface. Additionally, tap elements can also be configured and positioned the same as slide elements 62.

Further, forefoot flap 34 and heel flap 52 can be made of a low friction material themselves such that when they are in the downward or second position, first section 64 of forefoot flap 34 and first section 66 of heel flap 52 can contact the plastic slide surface used for slide aerobics. Thus, slide elements 72 may not be needed if flaps 34 and 52 are made of a suitable low friction material.

Figure 12:
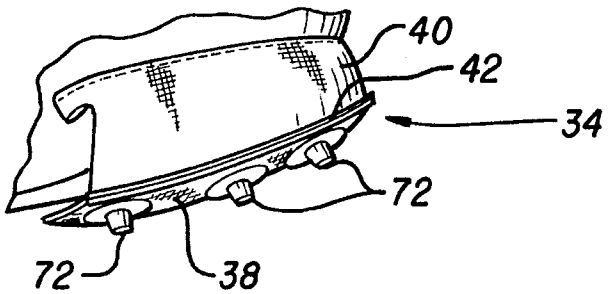
FIG. 12 is a partial side elevational view showing an alternative embodiment of the present invention wherein cleats are disposed on the forefoot flap and the flap is in its down position.

With reference to FIG. 12, forefoot flap 34 is shown with a substantially rigid spike element 72 disposed thereon instead of a tap or slide element. The structure of forefoot flap 34 and heel flap 52 can be such that spike elements can be attached to the flaps instead of tap elements. Thus, when forefoot flap 34 and heel flap 52 are in their upper positions, spike elements 72 will be out of contact with the surface upon which the shoe is used. When forefoot flap 34 and heel flap 52 are in their downward positions, spike elements 72 will be allowed to engage the ground and increase the traction of the shoe. Thus, as is apparent, the use of forefoot flap 34 and heel flap 52 is not limited to converting a shoe between an aerobic and tap dancing configuration or an aerobic and slide aerobic configuration, but they can be used to convert between other configurations, one such configuration being the use of spikes to increase the traction of the shoe. Some potential uses for the cleated version of the present invention would be for golf shoes or for increasing traction in icy conditions.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of the parts within the principle of the invention to the full extent indicated by the broad general meaning of the terms in which the appended claims are expressed.

I claim:

1. A convertible shoe for multipurposes, comprising:

an upper;

a sole attached to said upper; and a flap attached to the shoe, said flap having a ground engaging element disposed thereon, said flap having a first position wherein said flap is positioned in an overlying relationship to said upper such that a bottom surface of said sole can contact the surface upon which the shoe is being used and a second position wherein said flap is positioned in an overlying relationship to said sole such that said ground engaging element can contact the surface upon which the shoe is being used;

wherein a plurality of ground engaging elements are disposed on said flap and wherein said ground engaging elements are tap elements.

2. The shoe of claim 1 wherein said flap is attached to said upper.

3. The shoe of claim 1 wherein said flap is attached adjacent a lasting margin of the shoe.

4. The shoe of claim 1 wherein said flap is made of an elastic material, said flap conforming to the shape of the upper when in said first position and conforming to the shape of the sole when in said second position.

5. The shoe of claim 1 wherein said ground engaging element has a ground engaging surface and wherein said ground engaging surface faces an outside surface of said upper when said flap is in said first position and faces the surface upon which the shoe is being used when said flap is in said second position.

6. The shoe of claim 1 wherein said flap is positioned in a forefoot area of the shoe such that said flap overlies a vamp of said upper when in said first position and said ground engaging element is positioned over the bottom surface of said sole in the forefoot area of the shoe when said flap is in said second position.

7. The shoe of claim 1 wherein said flap is positioned in a heel area of the shoe such that said flap overlies a heel area of said upper when in said first position and said ground engaging element is positioned over the bottom surface of said sole when said flap is in said second position.

8. The shoe of claim 1 wherein the shoe has two flaps with a ground engaging element disposed on each flap, a first flap is positioned in a forefoot area of the shoe such that said first flap overlies a vamp of said upper when said first flap is in said first position and a first ground engaging element is positioned on the bottom surface of said sole when said first flap is in said second position, and wherein a second flap is positioned in a heel area of the shoe such that said second flap overlies a heel area of said upper when said second flap is in said first position and a second ground engaging element is positioned on the bottom surface of said sole when said second flap is in said second position.

9. The shoe of claim 1 wherein said plurality of ground engaging elements are spaced from one another on said flap such that said ground engaging elements allow said flap to conform to the shape of said upper when said flap is in said first position.

10. The shoe of claim 1 wherein said flap has a first portion and a second portion, said ground engaging element is disposed on said first portion, said first portion is disposed along the bottom surface of said sole when said flap is in said second position.

11. The shoe of claim 10 wherein said flap is located in a heel area of the shoe and said first portion of said flap is U-shaped.

12. A convertible shoe for multipurposes, comprising:

an upper;

a sole attached to said upper, said sole having a ground engaging surface;

a first flexible flap attached to the shoe in the forefoot area of the shoe and having a first position wherein said flap overlies an outer surface of the upper in the forefoot area of the shoe and a second position wherein said flap overlies the bottom of said sole in the forefoot area of the shoe;

a second flexible flap attached to the shoe in the heel area of the shoe and having a first position wherein said flap overlies an outer surface of the upper in the heel area of the shoe and a second position wherein said flap overlies the bottom of said sole in the heel area of the shoe, each of said first and second flaps having a ground engaging surface different from the ground engaging surface of said sole such that said first and second flaps in said second positions modify the shoe for use in a purpose different from the purpose the shoe is used for when the ground engaging surface of the sole contacts the ground;

a first ground engaging element being disposed on Said first flap such that said first ground engaging element can contact the surface upon which the shoe is being used when said first flap is in its second position; and a second ground engaging element being disposed on said second flap such that said second ground engaging element can contact the surface upon which the shoe is being used when said second flap is in its second position;

wherein both of said first and second ground engaging elements are tap elements.

13. The shoe of claim 12 wherein said first and second flaps are attached to said upper.

14. The shoe of claim 12 wherein said first and second flaps are attached adjacent a lasting margin of the shoe.

15. The shoe of claim 12 wherein said first flap is made of an elastic material, said first flap conforming to the shape of the upper in the forefoot area of the shoe when said first flap is in its first position and conforming to the shape of the sole in the forefoot area of the shoe when in its second position and wherein said second flap is made of an elastic material, said second flap conforming to the shape of the upper in the heel area of the shoe when said second flap is in its first position and conforming to the shape of the sole in the heel area of the shoe when in its second position.

16. The shoe of claim 12 wherein each of said ground engaging elements has a ground engaging surface and wherein said ground engaging surfaces face an outside surface of said upper when said flaps are in their first positions and face the surface upon which the shoe is being used when said flaps are in their second positions.

17. The shoe of claim 12 wherein a first plurality of ground engaging elements are disposed on said first flap and a second plurality of ground engaging elements are disposed on said second flap.

18. The shoe of claim 17 wherein said first plurality of ground engaging elements are spaced from one another on said first flap such that said first plurality of ground engaging elements allow said first flap to conform to the shape of said upper in the forefoot area of the shoe when said first flap is in its first position and wherein said second plurality of ground engaging elements are spaced from one another on said second flap such that said second plurality of ground engaging elements allow said second flap to conform to the shape of said upper in the heel area of the shoe when said second flap is in its first position.

19. The shoe of claim 12 wherein said first flap has a first portion and a second portion, said first ground engaging element is disposed on said first portion, said first portion is disposed along the bottom of said sole when said first flap is in said second position, and said first portion of said first flap is substantially the same shape as the forefoot area of said sole.

20. The shoe of claim 12 wherein said second flap has a first portion and a second portion, said second ground engaging element is disposed on said first portion, said first portion is disposed along the bottom of said sole when said second flap is in said second position, and said first portion of said second flap is U-shaped.

21. The shoe of claim 12 wherein said first and second flaps are attached to said upper.

22. The shoe of claim 12 wherein said first and second flaps are attached adjacent an lasting margin of the shoe.

23. The shoe of claim 12 wherein said first flap is made of an elastic material, said first flap conforming to the shape of the upper in the forefoot area of the shoe when said first flap is in its first position and conforming to the shape of the sole in the forefoot area of the shoe when in its second position and wherein said second flap is made of an elastic material, said second flap conforming to the shape of the upper in the heel area of the shoe when said second flap is in its first position and conforming to the shape of the sole in the heel area of the shoe when in its second position.

24. The shoe of claim 12 wherein said first flap has a first portion and a second portion, said first portion is disposed along the bottom of said sole when said first flap is in said second position, and said first portion of said first flap is substantially the same shape as a forefoot area of said sole.

25. The shoe of claim 12 wherein said second flap has a first portion and a second portion, said first portion is disposed along the bottom of said sole when said second flap is in said second position, and said first portion of said second flap is U-shaped.

* * * * *